US006674979B2

(12) United States Patent
Nagano

(10) Patent No.: US 6,674,979 B2
(45) Date of Patent: Jan. 6, 2004

(54) IMAGE FORMING APPARATUS ENABLED TO OPTIMIZE TRANSFER MEDIUM SLACK BETWEEN TRANSFERRING AND FIXING PORTIONS

(75) Inventor: Toshiyuki Nagano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,121

(22) Filed: Mar. 27, 2002

(65) Prior Publication Data

US 2002/0141774 A1 Oct. 3, 2002

(30) Foreign Application Priority Data

Mar. 28, 2001 (JP) ..... 2001-091870

(51) Int. Cl.[7] ..... G03G 15/20
(52) U.S. Cl. ..... 399/68; 399/16; 399/322
(58) Field of Search ..... 399/68, 67, 16, 399/320, 322, 397, 400

(56) References Cited

U.S. PATENT DOCUMENTS

| | | | | | |
|---|---|---|---|---|---|
| 4,941,021 | A | * | 7/1990 | Uchida et al. | 399/322 |
| 5,043,770 | A | | 8/1991 | Nagano et al. | 399/392 |
| 5,205,551 | A | | 4/1993 | Nagano et al. | 271/255 |
| 5,771,434 | A | * | 6/1998 | Hokari | 399/400 |
| 6,224,052 | B1 | | 5/2001 | Nagano | 271/127 |
| 6,408,146 | B1 | * | 6/2002 | Nagano | 399/67 |
| 2002/0141773 | A1 | * | 10/2002 | Nakamura | 399/68 |

FOREIGN PATENT DOCUMENTS

| | | | |
|---|---|---|---|
| JP | 7-261584 | | 10/1995 |
| JP | 8-190298 | | 7/1996 |
| JP | 2000-137421 | * | 5/2000 |
| JP | 2001-100587 | * | 4/2001 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has a fixing unit and a control for controlling a peripheral speed of a fixing rotatable member, the following formula being satisfied:

$$Pmin>Lmin$$

$$0<X\leqq\delta L/Pmax$$

V0: the peripheral speed;

Vf: a feeding speed;

Lmin: a minimum path length between a transfer nip and a fixing nip;

Lmax: a maximum guide path length between the transfer nip and the fixing nip;

δL=Lmax−Lmin: an amount of loop:

Pmax: a maximum length of the transfer material on which toner image may be formed;

Pmin: a minimum length of the transfer material on which the toner image may be formed;

X: a fluctuation rate of the feeding speed Vf during control of the peripheral speed.

11 Claims, 7 Drawing Sheets

IMAGE FORMING APPARATUS ENABLED TO OPTIMIZE TRANSFER MEDIUM SLACK BETWEEN TRANSFERRING AND FIXING PORTIONS

FIELD OF THE INVENTION AND RELATED ART

The present invention relates to an image forming apparatus such as a copying machine, a printer, or the like, which employs an electro-photographic or electrostatic recording method, or the like.

In an image forming apparatus such as a copying machine, an LBP, a facsimile machine, a microfilm reader/printer, or the like, first, an unfixed toner image in accordance with the image data of an intended image is indirectly (by transfer) or directly formed on the surface of a recording medium (transfer sheet, electro-facsimile sheet. electrostatic sheet, printing paper, and the like), with the use of an optional image forming method, for example, an electrophotographic image forming method, an electrostatic image forming method, or the like, and developer (toner) composed of thermally meltable resin or the like. The unfixed Loner image is thermally fixed to the recording medium by a heating apparatus (image heating apparatus, or image heating fixing apparatus); the unfixed image is turned into a permanent image by a heating apparatus. There are various types of heating apparatus. One of the most widely used types of heating apparatus is the heat roller type, which comprises: a heat roller as a heating member, the temperature of which is kept at a predetermined level; and a pressure roller as a pressing member, which has an elastic layer and is pressed upon the heat roller. It heats a recording medium, as an object to be heated, and the unfixed toner image thereon, while conveying the recording medium by the pressure roller, with the recording medium pinched by the heat roller and pressure roller.

In recent years, a film heating type heating apparatus has been gradually taking over the above described beat roller type heating apparatus. A film heating type heating apparatus comprises: a solidly supported heating member: a heat resistant film (fixing film), which is conveyed while being kept pressed upon the heating member; and a pressing member for keeping a recording medium, as an object to be heated, pressed upon the heating member, with the interposition of the heating film. It thermally fixes the unfixed image, which has been formed on a recording medium, by conducting the heat from the heating member, to the recording medium, through the heating film.

A film heating type heating apparatus can be used in various fields; not only can a film heating type heating apparatus be used as a fixing apparatus, but also as a means for heating a recording medium, which is bearing an image, to improve its surface properties (glossiness or the like), a means for temporarily fixing an unfixed image, or the like means for heating an object to be heated.

In the case of a film heating type heating apparatus, a heating member with a low thermal capacity, and a thin film, which are rapid in temperature increase, can be used. Therefore, a film heating type heating apparatus enjoys some advantages over a heat roller type heating apparatus. For example, it is smaller in electric power consumption, is shorter in wait time (warmup time), and is smaller in the amount by which the internal temperature or the main assembly of an image forming apparatus is increased by a heating apparatus.

When a film heating type heating apparatus of a pressure roller driving type is in operation, the film is slid on the heating member by rotationally driving the pressing member (which hereinafter will be referred to as pressure roller) kept pressed upon the heating member, with the interposition of the film, so that the film, or the combination of the film and an object to be heated, is conveyed through the compression nip between the heating member and pressure roller, remaining pinched by the heating member and pressure roller. Therefore, as the operation of the heating apparatus continues, the temperature of the pressure roller increases. As a result, the pressure roller increases in diameter due to the thermal expansion of its rubber portion.

Normally, the pressure roller is rotationally driven at a constant rotational angle. Thus, as the temperature of the pressure roller increases, the speed at which an object to be heated is conveyed increases, because the increase in the pressure roller temperature increases the amount of the thermal expansion of the pressure roller diameter, as described above, which results in the increase in the circumference of the pressure roller, and the increase in the circumference of the pressure roller results in the increase in the peripheral velocity of the pressure roller. In other words, the velocity at which an object to be heated is conveyed by a heating apparatus Is affected by the temperature of the pressure roller.

On the other hand, in an image forming apparatus which employs a heating apparatus, such as the above described one, as a thermal image heating apparatus, the velocity at which a recording medium is conveyed, on the upstream side or the heating apparatus, for example, in the image transferring portion, or one of the image processing portion, is kept constant. As the leading end of the recording medium reaches the compression nip (fixing nip) of the heating apparatus, the recording medium begins to be conveyed through the compression nip, remaining pinched by the heating member and pressure roller, before the trailing end of the recording medium comes out of the transferring portion. Thus, when the pressure roller temperature is high, and therefore, the recording medium conveyance velocity in the fixing nip of the heating apparatus has become greater than the recording medium conveyance velocity In the transfer portion as described above, the recording medium is pulled by the heating apparatus. As a result, the portion of an image, which is being conveyed through the transfer portion after the arrival of the leading end of the recording medium at the fixing nip, is blurred.

It is possible to set the recording medium conveyance velocity of the heating apparatus at a velocity lower than the recording medium conveyance velocity of the transferring portion, in consideration of the above described phenomenon that the recording medium is pulled by the heating apparatus. However, if such an arrangement is made, a recording medium is slackened between the transferring portion and fixing portion of the fixing apparatus, while the pressure roller temperature is low. This slack destabilizes the direction in which a recording medium separates from the transferring portion after image transfer, and/or the angle at which a recording medium enters the fixing nip portion of a heating apparatus. As a result, some of the toner particles are scattered from the unfixed toner image, and/or offset occurs in the fixing nip of the heating apparatus. Further, when a recording medium is thick, an image is blurred In the transferring portion due to the abrupt straightening of the recording medium caused by its resiliency.

In order to eliminate the problems resulting from the phenomenon that a recording medium is pulled or slackened by a heating apparatus due to the fluctuation in the velocity at which the recording medium is conveyed through the heating apparatus, while remaining pinched in the fixing nip portion, it was necessary to increases the distance between the transferring portion and the fixing nip portion of the heating apparatus so that the length of the time the recording medium is present in both the transferring portion and fixing nip portion of the heating apparatus is reduced.

However, in the case of an image forming apparatus which is enabled to accept a recording medium substantially longer than the standard recording medium, for example, a recording sheet of an A3 size, the above described solution in fact makes the distance between the transferring portion and fixing portion, across which the recording medium must be conveyed, long enough to substantially increase the size of the main assembly of the image forming apparatus.

Thus, as a solution different from the above described one, Japanese Laid-open Patent Application 7-261584 proposes a method in which the amount of the slack of a recording medium, or the conveyance velocity of the recording medium, is detected, and the velocity at which a pressure roller is driven is changed based on the detected amount of the slack, or the detected recording medium conveyance velocity. In the case of this method, however, the rotational velocity of the pressure roller cannot be adjusted until the first recording medium reaches the fixing device. Thus, it is probable that when a recording medium is conveyed at a high velocity, the adjustment of the rotational velocity of the pressure roller will fall behind.

There has also been proposed a method in which the pressure roller temperature is measured, and the velocity at which the pressure roller is driven is adjusted based on the amount of the pressure roller expansion estimated from the detected pressure roller temperature. This method, however, is greater in adjustment error, failing to drive the pressure roller at a proper velocity.

Japanese Laid-open Patent Application 8-190298 proposes another method. According to this method, the aforementioned fixing film is provided with a plurality of reflective plates, and the peripheral velocity of the film is detected by reading the period at which a reflection type sensor is turned on and off. Then, the velocity at which the pressure roller is driven is varied so that the measured peripheral velocity of the film remains constant. This method, however, requires the film to be provided with a plurality of reflective plates, increasing cost. Further, this method requires the intervals of the plurality of reflective plates to be equal. In order to make the intervals equal, the film must be highly accurately processed, which is rather difficult. In addition, this method requires the signals for controlling the peripheral velocity of the film to be continuously processed at a high speed, requiring therefore a more expensive CPU.

SUMMARY OF THE INVENTION

The primary object of the present invention is to provide an image forming apparatus capable of optimizing the amount of the slack of a recording medium between the transferring portion and fixing portion of the image forming apparatus.

Another object of the present invention is to provide an image forming apparatus capable of varying the peripheral velocity of the rotational fixing member.

According to an aspect of the present invention, there is provided an image forming apparatus comprising:

an image bearing member for carrying a toner image, the image bearing member being rotatable at a predetermined peripheral speed;

transfer means which forms with the image bearing member a transfer nip for transferring the toner image from the image bearing member onto a transfer material;

fixing means for fixing the image transferred from the image bearing member on the recording material, the fixing means including a fixing rotatable member and a pressing rotatable member which is press-contacted through the fixing rotatable member to form a fixing nip therebetween, the fixing nip being effective to nip and feed the transfer material;

control means for controlling a peripheral speed of the fixing rotatable member, wherein the following is satisfied:

$$Pmin > Lmin$$

$$0 < X \leq \delta L / Pmax$$

V0: the peripheral speed of the image bearing member;

Vf: a feeding speed of the fixing means;

Lmin: a minimum path length between the transfer nip and the fixing nip;

Lmax: a maximum guide path length between the transfer nip and the fixing nip;

$\delta L = Lmax - Lmin$; an amount of loop formed between the transfer nip and a fixing nip;

Pmax: a maximum length of the transfer material on which the image forming apparatus is capable of forming the toner image:

Pmin: a minimum length of the transfer material on which the image forming apparatus is capable of forming the toner image;

X: a fluctuation rate of the feeding speed Vf or the fixing means relative to the peripheral speed V0 of the image bearing member during control of the peripheral speed of the control means.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

(1) General Structure of Image Forming Apparatus

Figure 1:
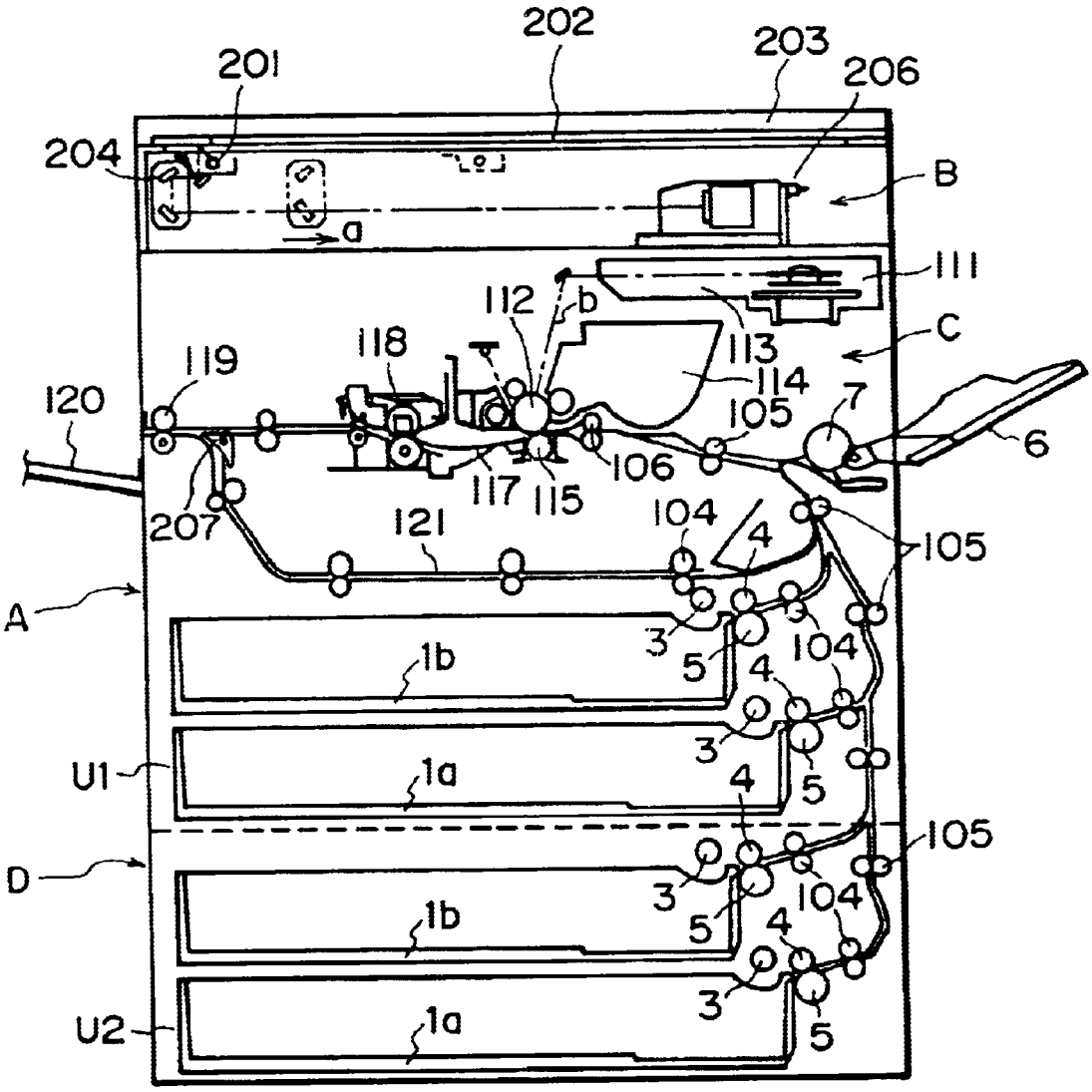
FIG. 1 is a vertical sectional view of an example of an image forming apparatus, for showing the general structure thereof.

FIG. 1 is a vertical sectional view of the image forming apparatus in an embodiment of the present invention. The image forming apparatus in this embodiment is a multifunctional image forming apparatus, which is equipped with an image reading scanner portion, and employs an electrophotographic image forming process of a transfer type.

The main assembly A of this image forming apparatus has an image reading scanner portion B, which is an image reading means for reading the image formation data of an image to be copied, and which is located at the top of the main assembly A. The main assembly A also has an image forming portion C which constitutes an image forming means, and a sheet deck D. The image forming portion C is located below the scanner portion B, and the sheet deck D is located below the image forming Portion C.

a) Image Reading Scanner Portion B

A referential code 202 stands for a horizontally positioned glass platen, across the top surface of which an original in the form of a book, a piece of cardboard, a piece of flat or rolled paper, or the like, is placed, with the image bearing surface racing downward, in accordance with a predetermined original mounting condition. The original placed on the glass platen is pressed against the glass platen by an original pressing plate 203, from the back side, so that it will be kept stationary.

As a reading start button is depressed, a mobile scanning unit which comprises a light source 201, a mirror 204, and the like, and is located on the bottom surface side of the glass platen 202, is moved along the bottom surface of the glass platen, from the home position located at the left end of the glass platen and contoured by a solid line, in the rightward direction indicated by an arrow mark a, at a predetermined velocity. As a result, the image bearing surface of the original on the top surface of the glass platen 202 is sequentially illuminated (scanned) left to right, while the light reflected by the image bearing surface of the original is focused into a light sensing element 206 (photoelectric transducer), being transduced into electrical voltage, which is converted by the image processing portion into a series of electrical signals which reflect the image formation data of the original. The thus created electrical signals are transmitted to the laser scanner in the image forming portion C.

As the mobile scanning unit reaches a predetermined point, its moving direction is switched, and returned to the home position from which it was moved out.

b) Image Forming Portion C

Figure 2:
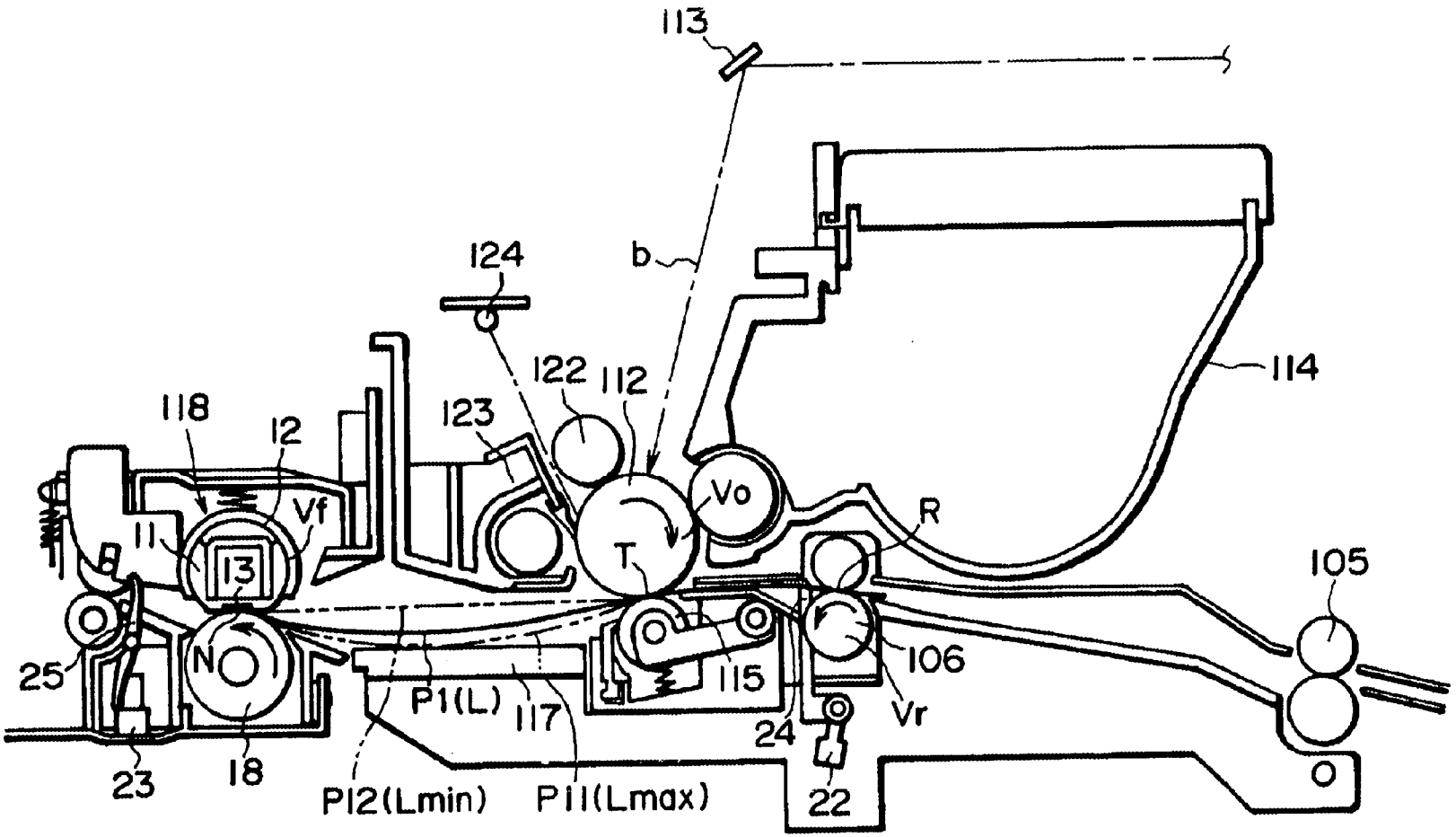
FIG. 2 is an enlarged vertical sectional view of the essential portion of the image forming portion of the image forming apparatus in FIG. 1.

FIG. 2 is an enlarged vertical sectional view of the essential portion of the image forming portion C. Referring to FIGS. 1 and 2, a referential code 112 stands for an electrophotographic photoconductive member ion the form of a rotational drum (which hereinafter will be referred to as photoconductive drum) as an image bearing member. This photoconductive drum 112 is rotationally driven in the clockwise direction at a predetermined peripheral velocity V0 (process speed). As it is rotationally driven, its peripheral surface is uniformly charged by roller 122 to predetermined polarity and potential level. The uniformly charged portion of the peripheral surface of the photoconductive drum 112 is exposed to a scanning beam b of laser light emitted, while being modulated by the image formation data, from the laser scanner 111 of the image writing optical system 113. As a result, an electrostatic latent image reflecting the exposure pattern is formed on the peripheral surface of the photoconductive drum 112.

After being formed on the peripheral surface of the photoconductive drum 112, the electrostatic latent image is developed by the developing device 114 into a toner image. The toner image is moved into the transferring portion T (transfer nip portion), which is the contact nip portion between the peripheral surfaces of the photoconductive drum 112 and transfer charge roller 115. In the transferring portion T, the toner image is sequentially transferred onto a transfer medium P, as a recording medium, (which hereinafter will be referred to as recording paper P), which has been delivered to the transferring portion T from the sheet feeding portion, with a predetermined control timing, and is being conveyed through the transferring portion T. The sheet feeding portion will be described later.

After receiving the toner image while being conveyed through the transferring portion T, the recording paper P is gradually separated from the peripheral surface of the photoconductive drum 112, starting from the leading end, and then is conveyed to the fixing apparatus 118, that is, a fixing portion, through a conveying portion 117 (recording paper conveying/guiding path). In the fixing apparatus 118, heat and pressure is applied to the recording paper P and the toner image thereon, as the recording paper is passed through the fixing nip portion N, while remaining pinched by the pressure roller and film. As a result, the unfixed toner image on the recording paper is fixed to the recording paper.

After the separation of the recording paper from the peripheral surface of the photoconductive drum 112, the contaminative residues, such as the residual toner particles, remaining adhered to the peripheral surface of the photoconductive drum 112 are removed by a cleaning device 123. Then, the portion of the peripheral surface of the photoconductive drum 112, from which the contaminative residues have been removed, is discharged by an eraser lamp 124 or the like, and is used for the following image formation cycle.

After being passed through the fixing apparatus 118, the recording paper P is discharged by a pair of discharge rollers 119 into a delivery tray 120 (or sorter) located outside the image forming apparatus main assembly, provided that the image forming apparatus is in the single-sided printing mode. As the recording paper is discharged into the delivery tray, it is placed on top of the preceding recording paper P.

Designated by referential codes 22 and 23 are first and second photo-interrupters as a paper detection sensor, which are provided with flag portions 24 and 25 (actuators) for detecting the arrival and departure, respectively, of the recording paper.

When the image forming apparatus is in the double-sided printing mode, a recording paper P is conveyed in the following manner. That is, as a recording paper which now is bearing a fixed image on a first surface is discharged from the fixing apparatus 118, the leading end of the recording paper P is pinched by the pair of discharge rollers 119, and is conveyed further until the trailing end of the recording paper P passes a reversal point 207. The moment the trailing end of the recording paper passes the reversal point 207, the rotation of the discharge rollers 119 is reversed, delivering the recording paper to a double-sided printing tray 121, in which the recording paper is temporarily placed. Then, the recording paper is conveyed by a pair of conveyance rollers 104 and a pair of conveyance rollers 105 to a registration roller pair 106, by which it is released with a predetermined control timing, to be delivered again to the transferring portion. In the transferring portion, an unfixed toner image is transferred onto a second surface of the recording paper in the same manner as an unfixed toner image is transferred onto the first surface of the recording paper. Then, the unfixed toner image is fixed to the second surface of the recording paper, and the recording paper is discharged into the delivery tray 120 in a manner to be placed on top of the preceding recording paper.

The registration roller pair 106 is made up of a driving roller and a pinch roller, which are placed in contact with each other. When the registration roller pair 106 is not being driven, a recording paper having been sent from the sheet feeding portion is caught by the compression nip R between the driving and pinch rollers, by the leading end, and is temporarily prevented from advancing, by the compression nip R; in other words, the recording paper is temporarily kept on standby. The registration roller pair 106 also functions to rectify the skewing of the recording paper. After being kept stationary for a predetermined length of time, the driving roller of the registration roller pair 106 is rotationally driven with a predetermined control timing at a predetermined peripheral velocity to release the recording paper so that it is delivered to the image transferring portion T. As the trailing end of the recording paper comes out of the compression nip R between the driving and pinch rollers, the driving of the driving roller is stopped to catch the following recording paper by the leading end.

As the signals from the image formation data processing portion of the image reading scanner portion B are inputted into the laser scanner as described above, the image forming apparatus main assembly A functions as a copying machine, whereas when the output signals from an external computer are inputted, it functions as a printer. In addition, when it receives the signals from other facsimile machines or sends the signals from the image formation data processing portion of the image reading scanner portion B to other facsimileing machines, it functions as a facsimileing machine.

c) Sheet Deck D

Mounted below the image forming portion C is the sheet cassette 1, which comprises two cassettes, that is, top and bottom cassettes 1*a* and 1*b*, together forming a sheet feeding unit. In this embodiment, the image forming apparatus main assembly A is enabled to accommodate two sheet feeding units U1 and U2, in other words, four cassettes. The sheet feeding unit U1, or the top unit, is removably attached to the apparatus main assembly A, and the sheet feeding unit. U2, or the bottom unit, is removably attached to the sheet deck D. Recording papers are automatically fed out of the selected cassette one by one.

More specifically, the recording papers stored in the cassettes 1*a* and 1*b* are drawn out of the cassette 1*a* or 1*b* by a pickup roller 3, which is a sheet feeding rotational member, and are separated one by one by the coordination of a feed roller 4 and a retard roller 5. Then, they are conveyed by roller pair 104 to the registration roller pair 106, which releases each recording paper with such timing that allows each recording paper to be delivered to the image transferring portion of the image forming portion C in synchronism with the corresponding image forming cycle.

The apparatus main assembly A is provided with a manual feeding tray 6, which is independent from the aforementioned sheet cassettes, and is attached to one of the side walls of the apparatus main assembly A, on the outward side. As a recording paper is placed in the manual feeding tray 6, it is drawn into the apparatus main assembly A by a manual feeding roller 7, and delivered to the registration roller pair 106.

(2) Fixing Apparatus 118

Figure 3:
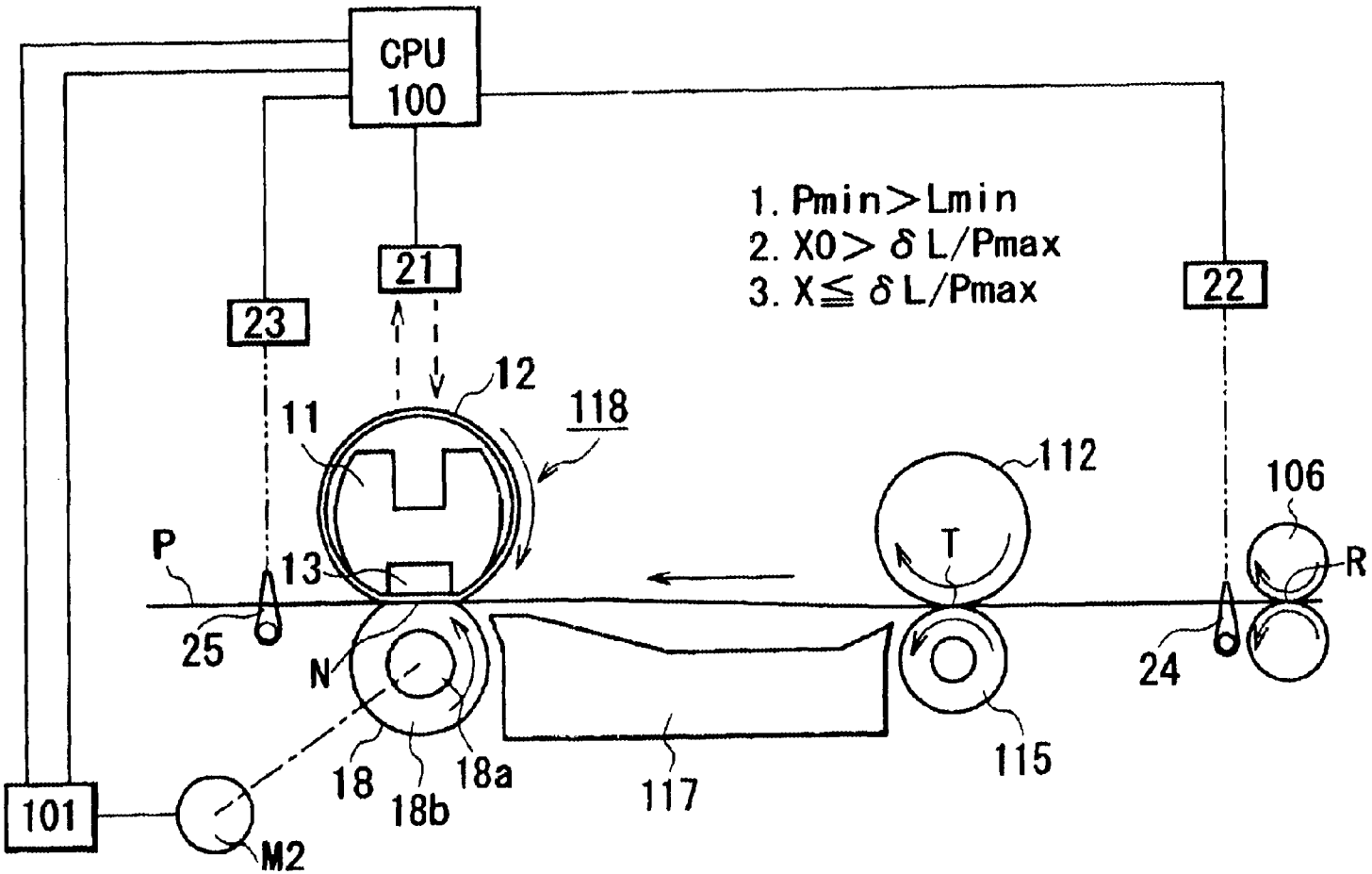
FIG. 3 is a combination of the schematic sectional view of the fixing apparatus and its adjacencies in the image forming apparatus in FIG. 1, and a block diagram of the control system in the image forming apparatus in FIG. 1.

FIG. 3 is a combination of a schematic sectional view of the fixing apparatus 118 and its adjacencies, for showing the general structure thereof, and a block diagram of the control system of the image forming apparatus.

The fixing apparatus 118 in this embodiment is a heating apparatus in which the pressure applying member is driven, and an object to be heated is heated through a tensionless film.

A referential code 11 stands for a stay, which is formed of resinous material superior in heat resistance as well as thermal insulation, and the lengthwise direction of which coincides with the direction perpendicular to the plane of FIG. 11.

A referential code 13 stands for a heating member with a low thermal capacity, for example, a ceramic heater, which is embedded in the bottom surface of the stay 11, and extends in the lengthwise direction of the stay. The ceramic heater 13 (fixing heater) essentially comprises a ceramic substrate in the form of a piece of thin plate, and a heat generating resistive member extended on the surface of the ceramic substrate in the lengthwise direction of the substrate. It is low in overall thermal capacity. Thus, as electric power is supplied to the heat generating resistive member, it quickly increases in temperature as the heat generating resistive member generates heat. The temperature of the ceramic heater is kept at a predetermined level for satisfactory fixation, by a temperature control system.

A referential code 12 stands for a cylindrical (in the form of an endless belt) heat resistant film (fixing film) fitted around the stay 11 inclusive of the heater 13. The circumferential length of the internal surface of the fixing film 12 is made longer by 3 mm, for example, than the circumference of a cylinder in which the stay 11 inclusive of the fixing heater 13 perfectly fits. Therefore, the fixing film 12 fairly loosely fits around the stay 11 inclusive of the fixing heater 13.

In order to reduce the warmup time by reducing the thermal capacity of the fixing film, the overall thickness of the fixing film 12 is made to be in a range of 40–100 $\mu$m. The fixing film 12 is made up of a base layer and an external layer. The base layer is formed of a material such as polyimide film, which is superior in, at minimum, heat resistance, releasing properties, strength, and durability. The external layer is formed of a mixture of fluorinated resin, such as PTFE or PFA, and a conductive additive, and is coated on the outward side of the base layer.

The fixing film 12 in this embodiment has three layers: a base layer formed of polyimide or the like; a primer layer coated on the outward surface of the base layer; and a coated layer formed by thinly coating fluorinated resin on the outward surface of the primer layer. In terms of electrical properties, the primer layer and coated layer are conductive or semiconductive, whereas the base layer is nonconductive. In order to make the primer layer and coated layer electrically conductive, the materials for the two layers are impregnated with carbon black. Therefore, the two layers are black.

Figure 4A:
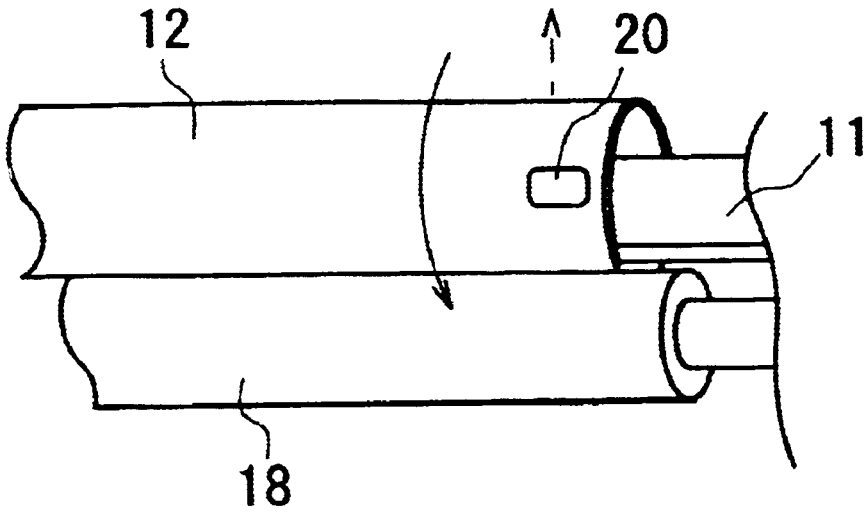
FIGS. 4(*a*) and 4(*b*) are drawings for describing the marked portion of the film and the detection sensor.
Figure 4B:
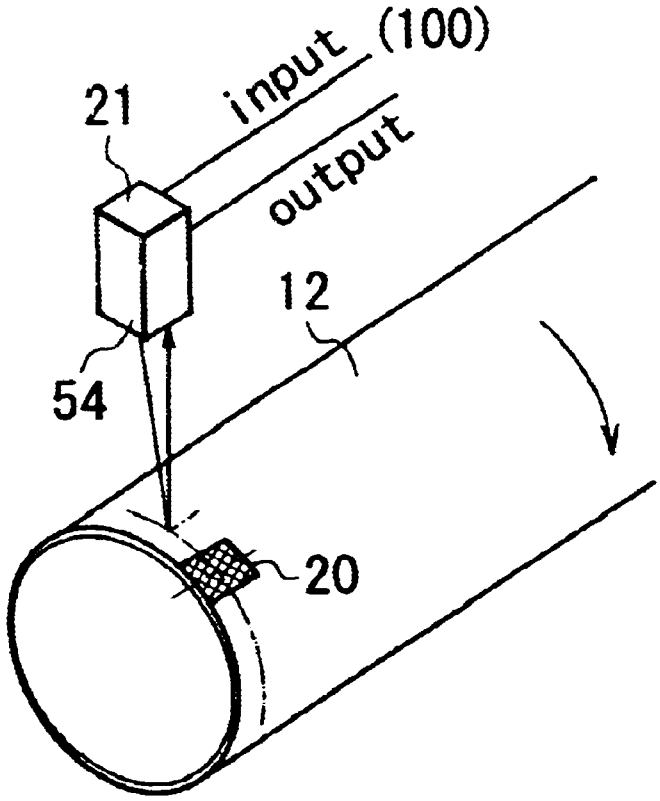

Referring to FIG. 4, the fixing film 12 is provided with a reflective mark 20, which is coated on the area outside the recording paper path, and the reflectance of which is higher than that of the surrounding area, or the film surface.

A referential code 18 stands for a pressure roller, which is kept pressed against the fixing heater 13, forming the fixing nip N, that is, a compression nip portion, with the interposition of the fixing film 12. The pressure roller 18 is a rotational member and drives the fixing film 12. It comprises a metallic shaft 18*a* formed of aluminum, iron, stainless steel, or the like, and a roller portion 18*b* fitted around the metallic shaft 18*a*. The roller portion 18*b* is formed of elastic rubber, such as silicone rubber, superior in releasing properties. It is 3 mm in thickness, and 20 mm in external diameter. For the purpose of improving the conveyability of the fixing film 12 and preventing the fixing film 12 from being contaminated by toner, and the like purposes, the peripheral surface of the roller portion 18*b* is coated with a layer of a material in which fluorinated resin has been dispersed.

As the metallic core 18*a* of the pressure roller 18 is driven in the counterclockwise direction indicated by an arrow mark by the fixing apparatus driving motor M2 (fixation motor), at one of the lengthwise ends, the pressure roller 18 Is rotated in the same direction. A referential code 101 stands for a motor driver. As the pressure roller 18 is rotationally driven, the fixing film 12 is rotated around the stay 11 in the clockwise direction indicated by an arrow mark, by the friction between the peripheral surface of the pressure roller 18 and the outward surface of the fixing film 12 in the fixing nip portion N, with the inward surface of the fixing film 12 sliding on the bottom surface of the heater 13 in the fixing nip portion N (pressure applying member driving method). In this case, it is recommendable for reducing the friction between the inward surface of the fixing film 12, and the bottom surface of the fixing heater that lubricant such as heat resistant grease is interposed between the two surfaces.

The stay 11 holds the fixing heater 13 while thermally insulating it, and also, functions as a guiding member for guiding the fixing film from inside the loop of the fixing film.

As the fixing film is rotated by the rotation of the pressure roller 18, with the temperature of the heater 13 kept at the predetermined level, to which the heater 13 has been started up, the recording paper P as a recording medium, which is bearing an unfixed toner image having been transferred onto the recording paper P, is delivered from the image transferring portion T to the fixing nip portion N, and fed between the rotational fixing film 12 and rotational pressure roller 18. Then, the recording paper P is conveyed through the fixing nip portion N, along with the fixing film 12, remaining pinched between the fixing film 12 and pressure roller 18. As a result, the heat from the fixing heater 13 is conducted to the recording paper P through the fixing film 12, thermally fixing the unfixed toner image on the recording paper P, to the recording paper P. After being passed through the fixing nip portion N, the recording paper P separates from the fixing film due to the curvature of the fixing film 12, and is conveyed further.

(3) Fixing Film Velocity Detecting Means

Referring to FIG. 4, a referential code 21 stands for a reflection type sensor, which is positioned above the rotational, path of the reflective mark 20 coated on the outward surface of one of the lengthwise end portions of the fixing film 12, outside the sheet path. As the reflective mark 20 is brought to the detection point by the rotation of the fixing film 12, the reflection type sensor 21 senses the arrival of the reflective mark 20 by detecting the increase in the reflectance at which the luminous flux from the reflection type sensor is reflected.

The reflective mark 20 of the fixing film 12 rotates as the fixing film 12 rotates, and passes below the refection type sensor 21 once for each rotation of the fixing film 12. Each time the reflective mark 20 passes below the reflection type sensor 21, the reflection type sensor 21 detects the light reflected by the reflective mark 20, and sends the signal generated by, the detection of the reflected light, to a CPU 100.

The CPU 100 calculates the time required for the fixing film 12 to rotate once, from the signal sent from the reflection type sensor 21, and the circumferential length of the fixing film 12, determining thereby the rotational velocity of the fixing film 12.

(4) Description of Mathematical Formulation of Relationship of Recording Paper Conveyance Velocity Between Transferring Portion and Fixing Portion, to Recording Paper Behavior As described before, according to the present invention in which 1) peripheral velocity of image bearing member: V0
2) conveyance velocity in fixing portion: Vf
3) amount of fluctuation in conveyance velocity in fixing portion: δVfmax
4) ratio of fluctuation in conveyance velocity in fixing portion under no control: X0=δVfmax/Vf
5) length of shortest recording paper path, or straight recording paper path, between nips of transferring portion and fixing portion: Lmin
6) length of longest recording paper path, or recording paper path by way of conveyance guide, between transferring portion and fixing portion: Lmax
7) amount of recording paper slack between transferring portion and fixing portion (path length difference): δL Lmax−Lmin
8) length of longest recording paper usable with image forming apparatus: Pmax
9) length of shortest recording paper usable with image forming apparatus: Pmin, the conveyance velocity Vf in the fixing portion is controlled by the CPU 100 in a manner to meet the following conditions:

$$Pmin > Lmin \qquad \text{Condition 1:}$$

$$X0 > \delta L/Pmax, \qquad \text{Condition 2:}$$

and, in a manner for the ratio X of the fluctuation in the conveyance velocity Vf in the fixing portion relative to the peripheral velocity V0 of the image bearing member, under the velocity control, to meet the following condition:

$$0 < X \leqq \delta L/Pmax. \qquad \text{Condition 3:}$$

In other words, when the amount δVfmax of the fluctuation In the conveyance velocity Vf in the fixing portion is large, the amount of the fluctuation in the slack of the recording paper P between the transferring and fixing portions is large, resulting in the phenomenon that a recording paper P is pulled by the fixing portion, or the phenomenon that the recording paper is substantially slackened between the transferring and fixing portions. Therefore, as the trailing end of the recording paper comes out of the nip portion R of the registration roller pair 106, the unfixed image on the recording paper is shocked, or disturbed. Further, in the case of a system in which the recording paper conveying means has been eliminated from the recording paper path 117 in order to reduce the cost and/or size of an image forming apparatus, it is mandatory that the shortest path length P12 (Lmin) between the transferring and fixing portions satisfies the following inequity:

$$Pmin > Lmin. \qquad \text{Condition 1:}$$

The registration roller pair 106 and photoconductive drum 112 are always rotated at predetermined velocities by an unshown main motor. The conveyance velocity Vr of the registration roller 106 is set at a value approximately 0.5% greater than that of the peripheral velocity of the photoconductive drum 112, while satisfying the following inequity:

$$V0<Vr<1.005\times V0 \quad \text{Condition 4:}$$

Satisfying this condition assures that a recording paper can be conveyed, being allowed to maintain a proper amount of slack while being conveyed between the transferring and fixing portions, without tensioning the recording paper between the transfer nip portion T and registration roller pair 109. Therefore, the image borne on the recording paper is not disturbed by the vibrations or shocks transmitted through the recording paper itself. Further, the overall magnification in terms of the recording paper conveyance direction remains at 102% or less, creating no problem in practical terms even when a recording paper of an A3 size is used.

In the present invention. Condition 1 ensures that the conveyance velocity Vf in fixing portion is kept within a predetermined range: Condition 3 ensures that the portion of a recording paper P between the transferring and fixing portions is given a proper amount of slack; Condition 4 ensures that the portion of a recording paper P between the registration roller pair and the transferring portion is given a proper amount of slack. Therefore, the occurrence of the aforementioned image disturbing shock is prevented.

Figure 5:
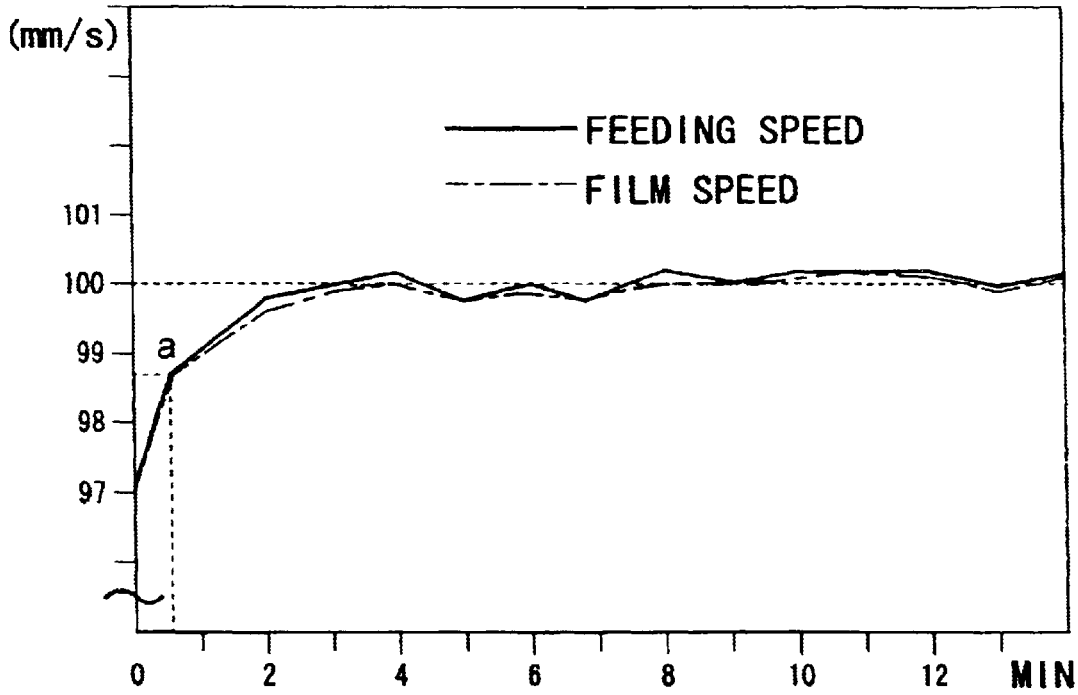
FIG. 5 is a graph for showing the correlation between the recording paper conveyance velocity and the fixing film velocity.

FIG. 5 is a graph for showing the fluctuation in the recording paper conveyance velocity (conveyance velocity in fixing portion) and the fluctuation in the rotational velocity of the fixing film 12. It was created by plotting the elapsed time. recording paper conveyance velocity, and fixing film velocity, after the fixing heater 13 was turned on and the fixing motor M2 began to be rotated. This experiment revealed that there was a correlation between the recording paper conveyance velocity and the rotational velocity of the fixing film 12, and therefore, the recording paper conveyance velocity can be estimated from the rotational velocity of the fixing film 12.

Thus, the rotational velocity of the fixing film 12 was fed back to the CPU 100 so that when the rotational velocity of the fixing film 12 detected by the sensor 21 was faster than a predetermined velocity, the CPU 100 (FIG. 4) reduced the velocity of the fixing motor M2 through the motor driver 101, whereas when the rotational velocity of the fixing film 12 was slower than the predetermined velocity, the CPU 100 increased the velocity of the fixing motor M2.

Next, the theory behind the velocity control in this embodiment will be described. Referring to FIG. 5, a referential code a represents the point in time at which the fixing apparatus 118 has sufficiently warmed up, in other words, the fixing apparatus 118 has become ready for an image fixing operation. From this point on, the conveyance velocity in the fixing portion increases to the saturation velocity of 100 mm/sec as a fixing operation, or heat applying operation, continues, and then, fluctuates from the saturation velocity at an approximate ratio of slightly more than 1%. Further, the conveyance velocity in the fixing portion fluctuates approximate 3% due to the changes in the circumference of the pressure roller and the circumferential length of the fixing film, the changes in the conveying performance ($\mu$) of the pressure roller affected by usage, and the like factors. Thus, when the apparatus is in use, the conveyance velocity in the fixing portion fluctuates a total of approximately 4%.

On the other hand, as for the amount of the recording paper slack between the transferring and fixing portions, referring to FIG. 2, the leading end of the recording paper P comes out of the transfer nip portion T, moves toward the fixing apparatus 118, following the locus P1, and enters the fixing nip portion N of the fixing apparatus 118. Thus, the amount of the slack, which is the difference between the length of the locus P1 and the shortest distance Lmin between the transferring and fixing portion, is: L−Lmin. As the conveyance velocity Vf in the fixing nip increases relative to the peripheral velocity V0 of the photoconductive drum, the slack disappears, whereas as the conveyance velocity Vf in the fixing nip decreases, the amount of the slack increases.

Lmin corresponds to the state of the recording paper, the tension of which is at the threshold level, beyond which the toner image on the recording paper begins to be disturbed by the recording paper slip in the transfer nip portion T.

Lmax corresponds to the state of the recording paper, the slack of which has increased to the threshold level, beyond which the recording paper slips in the transfer nip portion T due to the resiliency of the recording paper.

As the trailing end of the recording paper P comes out of the nip portion R of the registration roller pair 106, the restraint to the recording paper P is partially lost. This partial loss of the restraint sometimes causes the image disturbance in the transfer nip portion T. In order to prevent this image disturbance, control must be executed in a manner to satisfy the following inequity:

$$\text{Lmin}<\text{L}<\text{Lmax}.$$

The ratio X0 at which the conveyance velocity Vf in the fixing nip fluctuates relative to the peripheral velocity V0 of the photoconductive drum when no control is executed is 4% (X0=4%). In this case, if the length Pmax of the longest paper (A3 recording paper) on which an image can be formed by the image forming apparatus is 450 mm, the amount δL0 of the fluctuation in the slack of the recording paper under no control is:

$$\delta L0=450\times 0.04=18 \text{ mm}.$$

Further, the value of the length Lmin which satisfies Condition 1: Pmin>Lmin, when the length Pmin of the shortest paper (STMT size=139.7 mm paper) on which an image can be formed by the image forming apparatus is 139.7 mm, is:

$$\text{Lmin}=100.$$

Thus, the value of Lmax which allows the recording paper to slacken, but prevents the recording paper from straightening in a snappy manner, when the shortest length Lmin is 100 mm, 104 mm (these data are backed up by detailed experiments and calculation, which will be not described in this specification). Therefore, the threshold value of the amount δL of the fluctuation in the recording paper slack is:

$$\delta L=Lmax-Lmin=4 \text{ mm}$$

Therefore, δL0>δL, in other words, in theory, when the conveyance velocity Vf in the fixing portion is not controlled, an image is possibly disturbed.

Thus, the threshold ratio Xlim in the conveyance velocity in the fixing portion, beyond which the image disturbance occurs, is:

$$Xlim=\delta L/Pmax=4/450=0.89\%$$

Therefore. X0 (conveyance velocity fluctuation ratio under non control)>Xlim (Condition 2: X0>δL/Pmax). Therefore, without control, the image disturbance occurs.

Therefore, in order to assure image quality, the conveyance velocity Vf in the fixing portion must be controlled so that Condition 3: $X \leqq \delta L/Pmax$ ($X \leqq 0.89\%$) is satisfied. In the case of an actual image forming apparatus, a control system which satisfies an inequity: $X \leqq 0.6\%$ is mounted to provide a margin.

(5) Example of Control

Figure 6:
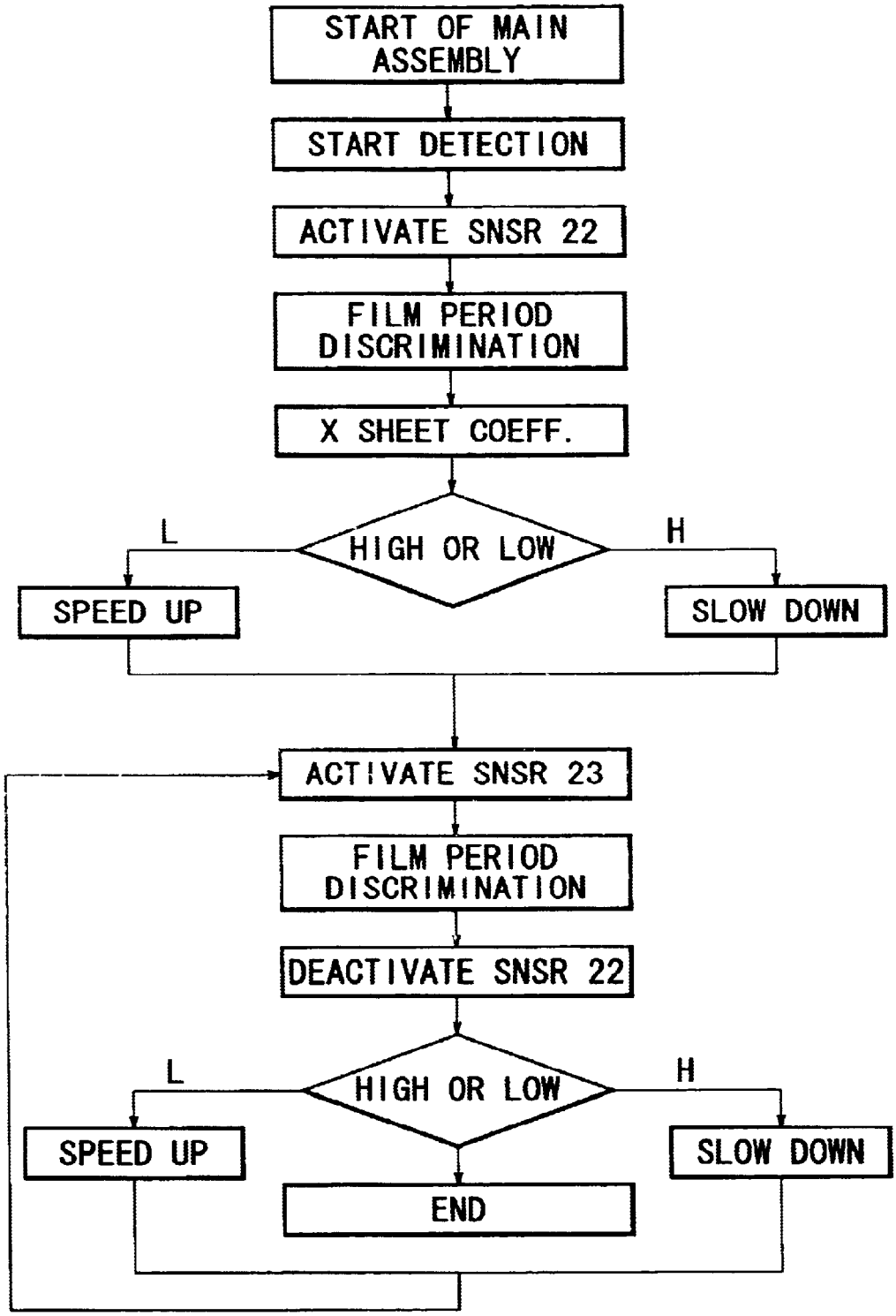
FIG. 6 is a flowchart of an example of the fixing film velocity control.

FIG. 6 is the flowchart for an example of the above described control.

1) Control for First Paper

As the electrical power supply to the image forming apparatus main assembly is turned on, power begins to be supplied to the fixing heater 13, and control Is executed to increase the temperature of the fixing apparatus 118 to a predetermined level. While the temperature of the fixing apparatus is increased to the predetermined level, the temperature of the pressure roller 18 also increases. Therefore, the pressure roller 18 begins its thermal expansion.

Consequently, the peripheral velocity of the pressure roller 18 begins to increase, increasing therefore the rotational velocity of the fixing film 12 as shown in FIG. 5. At this stage, however, the rotational velocity of the fixing film 12 is slower than a desired velocity, which is obvious.

The refection type sensor 21 constantly detects the fixing film period (rotational period). As a recording paper P reaches the paper detection sensor 24, the photo-interrupter 22 is turned on. At this point in time, the CPU 100 picks up the data D1 regarding the latest fixing film period, and compares this fixing film period with the target fixing film period T. Then, it increases or decreases the conveyance velocity in the fixing portion. In the case of the first recording paper, however, the following factors need to be taken into consideration.

Figure 7:
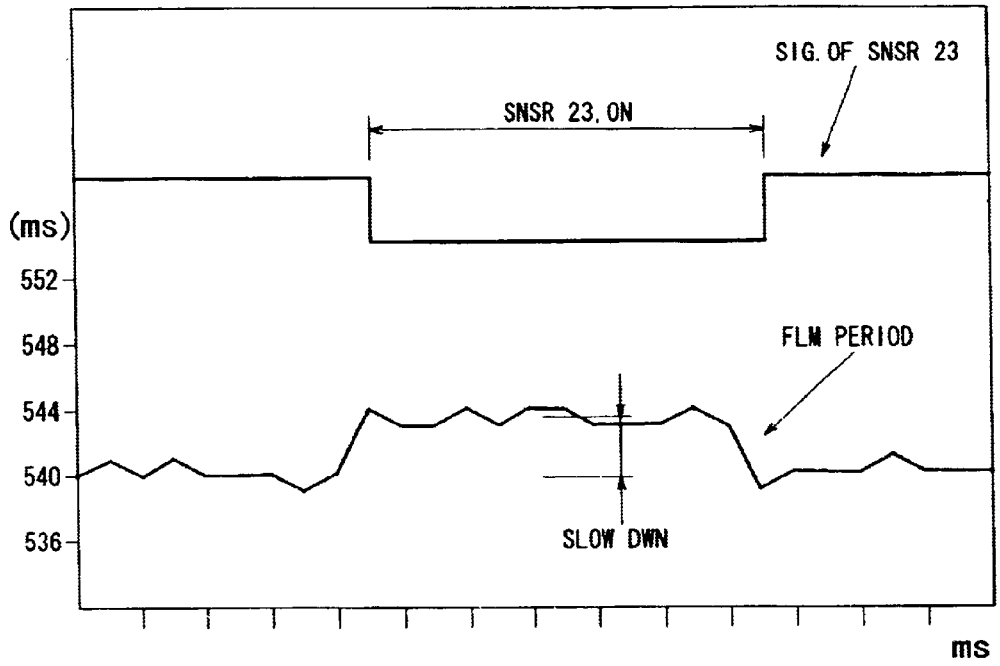
FIG. 7 is a graph for showing the fluctuation in the fixing film period, which occurs while a single sheet of recording medium passes through the image forming apparatus, when the fixing film velocity is not controlled.

FIG. 7 is a graph for showing the fluctuation in the fixing film period, which occurred while a single recording paper was passed through the image forming apparatus without executing the velocity control. It is evident from this graph that the fixing film period was longer while the recording paper was present in the fixing nip portion N than while the recording paper was not present in the fixing nip portion N It has been known from experiments that the ratio of this increase in the fixing film period is approximately 0.8%.

Thus, if the velocity at which the pressure roller 18 is driven (which hereinafter will be referred to as pressure roller velocity) is set based on the above described fixing film period data D1, the fixing film velocity becomes slower than the desired one, reducing therefore the recording paper velocity. As a result, the image on the recording paper is disturbed.

Thus, the fixing film period data D1 is multiplied by a paper coefficient A for compensating for the increase in the fixing film period caused by the passage of the recording paper P, obtaining a fixing film period data D1*a,* which is compared with the target fixing film period T.

$$D1a = PC \times D1$$

PC: paper coefficient, which is 1.008 in this embodiment.

Then, the pressure roller velocity is immediately increased or reduced so that by the time the first recording paper reaches the fixing nip portion N of the fixing apparatus 118, the rotational velocity of the fixing film 12 will have reached the desired level and will be maintained at the desired level. Therefore, the recording paper conveyance velocity in the fixing apparatus becomes the desired one. As a result, a satisfactory copy obtained.

2) Control for Second Recording Paper and Recording Papers Thereafter

As the first recording paper reaches the paper detection sensor 25, the photo-interrupter 23 is turned on. At this moment, the CPU 100 picks up the data D2 regarding the latest fixing film period. At this stage, the first recording paper is present in the fixing nip portion N, the data D2 does not need to be multiplied by the paper coefficient PC, unlike the data D1. In other words, the data D2 has only to be simply compared with the target fixing film period T.

At this stage, if the velocity of the fixing motor M2 is immediately changed as it becomes necessary, a problem arises, for the following reason. That is, at this stage, the trailing end of the recording paper is more likely to be present in the transferring portion (transfer nip portion) than not. Thus, if the recording paper velocity suddenly changes, the vibrations resulting from the sudden change in the recording paper velocity are transmitted through the recording paper, possibly causing the image on the recording paper to be blurred.

Therefore, at this stage, the motor velocity is not immediately changed. Instead, it is changed to the desired velocity, E seconds after the paper detection sensor 24 is turned on. The value of E is set so that a sufficient amount of time is provided for the trailing end of the recording paper to come out of the transferring portion T after passing by the paper detection sensor 24. In other words, the velocity of the fixing motor M2 is changed after the recording paper completely comes out of the transferring portion T.

The second recording paper is conveyed at a velocity corresponding to the latest motor velocity set as described above. Then, as the leading end of the second recording paper reaches the paper detection sensor 25, the photo-interrupter 23 is turned on. At this moment, the CPU 100 picks up the data D3 regarding the latest fixing film period, and compares the data D3 with the target fixing film period T, determining thereby the next motor velocity. Then, it changes the velocity of the fixing motor M2 with the timing similar to the above described one. For the third recording paper and thereafter, the control executed for the second recording paper has only to be repeated.

As described above, according to this embodiment, the problems that in an image forming apparatus called a short path engine, an unfixed image on a recording paper is disturbed by the fluctuation in the fixation velocity, is theoretically elucidated, and mathematical formula for calculating control values are provided. Therefore, the same theory can be applied to various short path engines different in structure and operation, for example, different in the positioning of the units in the engine. Even though the preceding embodiment of the present invention was described with reference to a short path engine of a horizontal recording paper path type, the theory behind the above described embodiment is also applicable to a short path engine of a vertical recording paper path type In other words, the present invention has merit in that technologies can be standardized to reduce the time required for the development of new apparatuses, and also to simplify the process for making the newly developed apparatuses marketable.

According to this embodiment of the present invention, the fixing film 12 is provided with the heat resistant and highly reflective mark 20, which is formed by sintering, and the velocity of the fixing film 12 is determined from the rotational period of the fixing film 12 detected by the refection type sensor 21. The recording paper conveyance velocity is estimated from the velocity of the fixing film 12, and the velocity at which the pressure roller 18 is driven is controlled based on the estimated recording paper conveyance velocity. In the case of such a system, control can be executed by detecting the time required for the fixing film to rotate once. Therefore, the number of the reflective marks 20, formed of reflective substance or the like, which are placed on the fixing film 12, has only to be one, making it possible to reduce manufacture cost. Further, such a system makes it possible to eliminate the concern about the accuracy in the reflective plate interval, making manufacture easier. Further, a signal has to be processed only once per recording paper. Therefore, an inexpensive CPU suffices. Incidentally, two or more reflective marks may be provided. For the purpose of detecting the time required for the fixing film 12 to rotate once, however, the number of the reflective marks is desired to be one.

Further, when the first recording paper is conveyed, in other words, when a recording paper is not present in the fixing portion N, the fixing film velocity is adjusted based on the product of the detected fixing film velocity and the paper coefficient. Therefore, the recording paper conveyance velocity can be controlled before the first recording paper reaches the fixing portion N of the fixing apparatus 118. Consequently, a satisfactory images can be always obtained. Further, it is possible to make the fixing apparatus 118 compatible with a high speed recording operation.

Next, another embodiment of the present invention will be described.

The control system employed in the above described embodiment of the present invention is a system in which in order to match the target film rotation period T and latest film rotation period data D, in other words, in order to reduce the ratio X of the fluctuation of the conveyance velocity in the fixing portion to zero (X=0), the velocity of the fixation motor M2 is infinitely varied. Such a system requires a large number of referential values based on a quartz-crystal frequency. In other words, controlling the pressure roller velocity in a stepless manner in order to stabilize the peripheral velocity of the fixing film requires a complicated control mechanism, and also, is likely to make the control routine unstable.

Next, an embodiment in which the velocity at which the pressure roller is driven is varied in steps will be described.

Figure 8:
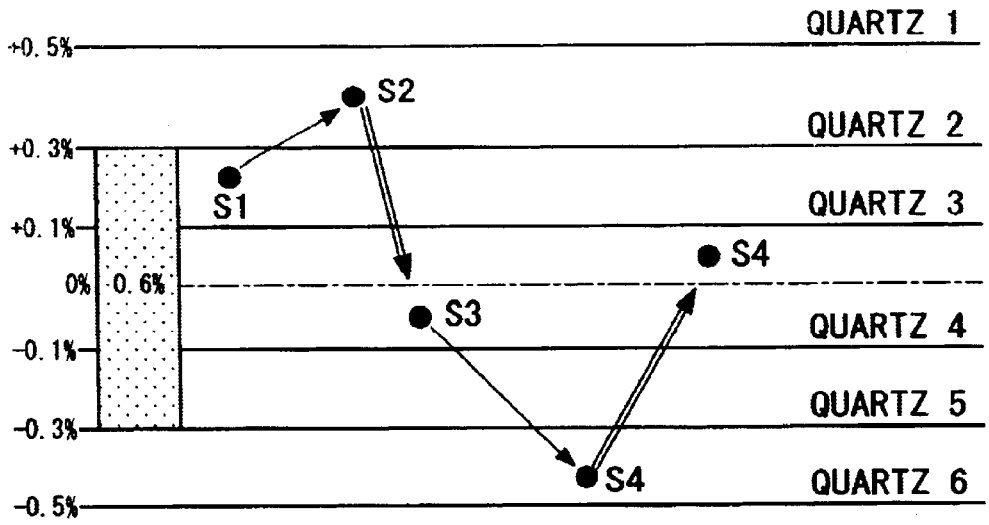
FIG. 8 is a graph for showing how the velocity at which the pressure roller is driven is switched in another embodiment of the present invention.

As described above, in the case of an image forming apparatus in accordance with the present invention, image quality is assured as long as the ratio X of the fluctuation of the conveyance velocity in the fixing portion (relative to the photoconductive drum velocity V0) satisfies an inequity: $X \leqq 0.6\%$. FIG. 8 shows a control system enabled to drive the fixing motor M2 at six different velocities using a minimum of six referential values based on quartz-crystal frequency. The interval of the referential values is made to correspond to 0.2% of the peripheral velocity V0 of the photoconductive drum. In order to reduce the quartz-crystal based referential value counts, no referential value is assigned to the fixing motor M2 velocity corresponding to the peripheral velocity V0 of the photoconductive drum.

In the case of this embodiment, the feedback based control is carried out in the following manner. When the difference between the target fixing film velocity, and a fixing film velocity S1 calculated from the actual fixing film period data D, is within a control range of 6%, that is, between −0.3%–+0.3%, basically, the fixing film velocity does not need to be adjusted. However, as the fixing film velocity S1 increases to a fixing film velocity S2 due to temperature changes or the like, in other words, the calculated fixing film velocity moves out of the tolerable range, the quartz-crystal frequency based referential value 4 is selected to reduce the fixing film velocity by two steps, so that the actual fixing film velocity converges to a velocity S3, the deviation of which from the target fixing film velocity falls within ±0.1%. If the calculated fixing film velocity falls from the velocity S3 to a velocity S4, the fixing film velocity is increased by two steps so that the fixing film velocity converges to a velocity S5, the deviation of which from the target velocity is within ±0.1%. With the employment of this control system, the deviation of the fixing film velocity from the target velocity can be kept within ±0.3%, satisfying the aforementioned inequity: $X \leqq 0.6\%$, with the use of a simple system.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member for carrying a toner image, said image bearing member being rotatable at a predetermined peripheral speed;

transfer means which forms with said image bearing member a transfer nip for transferring the toner image from said image bearing member onto a transfer material;

fixing means for fixing the image transferred from said image bearing member on the transfer material, said fixing means including a fixing rotatable member and a pressing rotatable member which is press-contacted through said fixing rotatable member to form a fixing nip therebetween, the fixing nip being effective to nip and feed the transfer material;

control means for controlling a peripheral speed of said fixing rotatable member, wherein the following is satisfied:

$$Pmin > Lmin$$

$$0 < X \leqq \delta L / Pmax$$

V0: the peripheral speed of said image bearing member;

Vf: a feeding speed of said fixing means;

Lmin: a minimum path length between the transfer nip and the fixing nip;

Lmax: a maximum guide path length between the transfer nip and the fixing nip;

$\delta L = Lmax - Lmin$: an amount of loop formed between the transfer nip and a fixing nip;

Pmax: a maximum length of the transfer material on which said image forming apparatus is capable of forming the toner image;

Pmin: a minimum length of the transfer material on which said image forming apparatus is capable of forming the toner image;

X: a fluctuation rate of the feeding speed Vf of said fixing means relative to the peripheral speed V0 of said image bearing member during control of the peripheral speed of said control means.

2. An apparatus according to claim 1, wherein the following is satisfied:

$$X0 > \delta L / Pmax$$

αVfmax: an amount of fluctuation of the feeding speed of said fixing means;

δVfmax: an amount of fluctuation of the feeding speed of said fixing means;

X0=δVfmax/Vf: a fluctuation rate of the feeding speed of said fixing means when the peripheral speed of said fixing rotator or member is not controlled.

3. An apparatus according to claim 1, further comprising detecting means for detecting the peripheral speed of said fixing rotatable member, said control means controlling the peripheral speed of said fixing rotatable member of the basis of a result of detection of said detecting means.

4. An apparatus according to claim 3, wherein said control means has a plurality of target rotational speeds of said pressing rotatable member and selects one of them.

5. An apparatus according to claim 4, wherein said control means selects a lower one of the rotational speeds of said pressing rotatable member and when the peripheral speed of said rotatable fixing member exceeds a predetermined peripheral speed.

6. An apparatus according to claim 4, wherein said control means selects a higher one of the rotational speeds of said pressing rotatable member when the peripheral speed of said rotatable fixing member is lower than a predetermined peripheral speed.

7. An apparatus according to claim 4, wherein said target rotational speeds are all different from the peripheral speed of said image bearing member.

8. An apparatus according to claim 3, wherein said detecting means detects time required by one full rotation of said fixing rotation member.

9. An apparatus according to claim 8, wherein said fixing rotatable member has a single detection mark on a peripheral surface thereof.

10. An apparatus according to claim 8, further comprising a transfer material sensor for detecting the transfer material at a position upstream the transfer nip with respect to a movement direction of the transfer material, wherein said control means detects a peripheral speed of said fixing rotatable member of the basis of time duration of one full turn of said fixing rotatable member when said sensor detects the transfer material.

11. An apparatus according to claim 1, further comprising a registration roller for feeding the transfer material toward the transfer nip in a timed relation with an image on said image bearing member, wherein the following is satisfied:

$$V0<Vr<1.005V0$$

Vr: a speed of feeding the transfer material by the registration roller.

* * * * *

UNITED STATES PATENT AND TRADEMARK OFFICE

CERTIFICATE OF CORRECTION

PATENT NO. : 6,674,979 B2
DATED : January 6, 2004
INVENTOR(S) : Toshiyuki Nagano It is certified that error appears in the above-identified patent and that said Letters Patent is hereby corrected as shown below:

Column 5,
Line 60, “ion” should read -- in --.

Column 10,
Line 48, “In” should read -- in --.

Column 17,
Lines 1-2, should be deleted.
Lines 19 and 24, “rotatable fixing member” should read -- fixing rotatable member --.

Column 18,
Line 3, “rotation” should read -- rotatable --.
Line 13, “of the” should read -- on the --.

Signed and Sealed this

Thirteenth Day of April, 2004

JON W. DUDAS
*Acting Director of the United States Patent and Trademark Office*